US008911177B2

(12) United States Patent
Quan

(10) Patent No.: US 8,911,177 B2
(45) Date of Patent: Dec. 16, 2014

(54) STOWING METHOD FOR GOAF OF POTASH SALT ORE

(71) Applicant: Sino-Agri Mining Investment Co., Ltd., Beijing (CN)

(72) Inventor: Wang Quan, Beijing (CN)

(73) Assignee: Sino-Agri Mining Investment Co., Ltd., Beijing (CN)

( * ) Notice: Subject to any disclaimer, the term of this patent is extended or adjusted under 35 U.S.C. 154(b) by 0 days.

(21) Appl. No.: 13/730,060

(22) Filed: Dec. 28, 2012

(65) Prior Publication Data

US 2013/0170912 A1 Jul. 4, 2013

(30) Foreign Application Priority Data

Dec. 30, 2011 (CN) ..... 2011 1 0458026

(51) Int. Cl.
*B09B 3/00* (2006.01)
*E21F 15/00* (2006.01)
*E21F 15/02* (2006.01)

(52) U.S. Cl.
CPC ..... *E21F 15/005* (2013.01); *E21F 15/02* (2013.01)
USPC ..... 405/129.3

(58) Field of Classification Search
USPC ..... 405/129.1, 129.2, 129.3, 129.35, 405/129.45, 129.6, 129.65, 267
See application file for complete search history.

(56) References Cited

U.S. PATENT DOCUMENTS 5,551,806 A * 9/1996 Milliken ..... 405/266
5,947,644 A * 9/1999 Gibbons et al. ..... 405/267
2010/0011994 A1* 1/2010 Blackburn et al. ..... 106/677

FOREIGN PATENT DOCUMENTS

CN 101864988 A 10/2010
CN 101864989 A 10/2010

* cited by examiner

*Primary Examiner* — Tara M. Pinnock
*Assistant Examiner* — Patrick Lambe
(74) *Attorney, Agent, or Firm* — Blakely, Sokoloff, Taylor & Zafman LLP

(57) ABSTRACT

A method of stowing a goaf of potash salt ore comprising making wall slurry into barricades each have the same area as the sectional area of a tunnel and a thickness of 0.5 to 5 meters inside the underground tunnels in goaf of potash salt ore, with the interval between adjacent barricades being 5 to 100 meters, then stowing the interval between the barricades by using the filling slurry is described. The stowing method uses the wall slurry of high strength that is solidified with a gelling agent as the main bearing material, and uses the solidified filling slurry with a low strength as the main filling material, which has a good effect when compared with conventional filling materials. Moreover, the stowing method effectively utilizes the tail liquids, thereby reducing the addition of other additives, decreasing the cost, avoiding the discharge of liquid waste and relieving the environmental pressure.

13 Claims, 2 Drawing Sheets

STOWING METHOD FOR GOAF OF POTASH SALT ORE

TECHNICAL FIELD

The present invention relates to a stowing method for a mining goaf, in particular to a stowing method for a goaf of potash salt ore.

BACKGROUND ART

The potash slat ore such as carnallite produces tailing and tail liquid during common mineral floatation process, wherein more than 90% of the tailing is NaCl, and the tailing is normally piled up in a tailing pond or dryly filled into a goaf. The main ingredients of the tail liquid are 22% to 25% of $MgCl_2$, 3.3% to 4.4% of KCl and 1.8% to 3.3% of NaCl. The tail liquid is normally used for recycling carnallite by concentration or is directly discharged to outside. Until now, there is not an economic and effective method for treating the carnallite tail liquid at home and abroad yet.

During a stowing process in an ordinary mine, a silicate cement is generally used as a cement material for mixing with the tailings to prepare filling slurry for stowing. Traditional stowing methods may not be suitable for the goaf of potash salt ore, because a recovery in a goaf of potash salt ore usually has a strict requirement on the strength of stowing. Being affected by the chloridion, the solidification strength of silicate cement is greatly reduced after being solidified, along with its cost that is too high, so it is unable to meet the stowing requirements.

With respect to a goaf of potash salt ore, there are currently a lot of stowing methods, such as a stowing method for a goaf disclosed in CN 101864989A, which mixes tailings, magnesium cement and coal ash to prepare filling slurry to be transferred to a goaf. CN 101864988A discloses a stowing method for a goaf of potash salt ore, which mixes tailings and magnesium cement to prepare filling slurry to be transferred to a goaf. The above methods all utilize a single filling slurry, the stowing strength is not easy to be controlled, and the cost for stowing is too high; moreover, only the tailing is treated while the tail liquid is not effectively utilized, and the discharge of tail liquid results in a great environmental pressure.

SUMMARY

In order to overcome the defects of single filling slurry and of ineffective utilization of the tail liquid, the present invention aims to provide a stowing method for a goaf of potash salt ore.

According to the stowing method for a goaf of potash salt ore provided by the present invention, wall slurry is made into barricades inside underground tunnels in a goaf of potash salt ore, the barricade has the same area as the sectional area of the tunnel and a thickness of 0.5 to 5 meters, with an interval between adjacent barricades of 5 to 100 meters, then said interval between the barricades is filled with the filling slurry.

Wherein, said wall slurry is comprised of the following ingredients by weight:

tail liquid of carnallite potash salt ore: 20~40%;

tailing of carnallite potash salt ore: 30~60%;

gelling agent 8~25%;

modifier 2~8%;

said filling slurry is comprised of the following ingredients by weight:

tail liquid of potash salt ore such as carnallite: 17~46%;

tailing of potash salt ore such as carnallite: 50~80%;

gelling agent: 1~5%.

a thickness of the barricade and an interval between the barricades are generally determined by the actual conditions of the goaf; the thickness of the barricade is preferably 1~5 meters, more preferably 1~3 meters; the interval between adjacent barricades is preferably 5~50 meters, more preferably 10~30 meters, most preferably 10~20 meters.

Preferably, after stowing, the amounts of said wall slurry and filling slurry that are used have a volume ratio of 5~10: 90~95 there-between.

The method for preparing said wall slurry comprises: adding a gelling agent and a modifier into the tail liquid of potash salt ore such as carnallite; after stirring uniformly, further adding the tailing of potash salt ore such as carnallite and mixing uniformly so as to obtain the wall slurry; the method for preparing said filling slurry comprises: adding a gelling agent into the tail liquid of potash salt ore such as carnallite, after stirring uniformly, further adding the tailing of potash salt ore such as carnallite and mixing uniformly, so as to obtain the filling slurry.

Said filling slurry can be prepared in advance and then filled between said barricades, or, said filling slurry can also be formed by separately filling the raw materials between the barricades and mixing them therein.

The mass percent of magnesium chloride in the tail liquid of potash salt ore such as carnallite is 29~36%. If the mass percent of magnesium chloride in the tail liquid is below or above such concentration range, it can be adjusted with conventional ways by adding water when above such range, and by concentrating when below such range, such as a concentration through water evaporation under sun exposure, respectively.

The gelling agent is magnesium oxide, calcium oxide or a mixture thereof.

In the wall slurry or filling slurry, the main ingredients of a solidified agent includes a lot of elements. With the increase of an amount of magnesium oxide that is added, the ratio of $Mg(OH)_2$ in the main ingredients will be increased continuously, successively being $2Mg(OH)_2.MgCl_2.8H_2O$, $3Mg(OH)_2.MgCl_2.8H_2O$, $5Mg(OH)_2.MgCl_2.8H_2O$, etc.; with the increase of amount of calcium oxide that is added into the gelling agent, the ratio of $2MgCl_2.CaCl_2.12H_2O$ and $CaCl_2.6H_2O$ will be increased. When the gelling agent is pure magnesium oxide which is added at a sufficient amount, the main solidification agent is $5Mg(OH)_2.MgCl_2.8H_2O$, so the resulted wall will obtain a highest strength; when the gelling agent is pure calcium oxide which is added at a sufficient amount, the resulted wall will obtain a lowest strength.

The strength of the generated solidification substance is varied with different types of gelling agents, therefore, the strength of solidification substance can be adjusted by changing types and ratios of the gelling agent that is added, and the stowing cost can also be controlled.

The filling slurry has a major function of stowing, which has low requirements of strength, thus it is preferred to purely utilize calcium oxide with a lower cost.

For the wall slurry, according to the different requirements of bearing strength, the amounts of magnesium oxide and calcium oxide that are utilized can be adjusted within a certain range, wherein the mass percent of magnesium oxide is 0~17% and the mass percent of calcium oxide is 0~8%.

When the gelling agent in the wall slurry is pure magnesium oxide, the resulted slurry will obtain a highest strength, as shown in FIG. 1. When the amount of magnesium oxide that is added is 17% without addition of calcium oxide, the compression strength can be up to 35 MPa after being solidified for 28 days, which, however, also results in a highest operation cost; when the gelling agent is pure calcium oxide, the cost is lowest, which however will result in a poor strength for the slurry of only about 0.8 MPa, and can not meet the bearing requirements. When the gelling agent is a mixture of magnesium oxide and calcium oxide, the cost is moderate, and the strength can also be adjusted within a relative large range as required, so as to be applied in goaf stowing with different strength requirements, and to achieve optimum economy.

Based on the above grounds, more preferably, the mass percent of magnesium oxide in the wall slurry is 10~16%, and the mass percent of calcium oxide therein is 2~6%.

The modifier for the wall slurry is a mixture of three materials, which are sodium silicate, sodium phosphate and coal ash. Wherein, the sodium silicate is used as a hole-plugging agent, which can delay the solidification to some extent when being added at a small amount; the sodium phosphate is used as a slurry retarder, which can adjust the solidification time of the slurry; and the coal ash is used as a hole-plugging agent, which can increase the water resistance of solidification materials.

Preferably, in the wall slurry, the mass percent of the sodium silicate is 0.5~1.5%; the mass percent of the sodium phosphate is 0.5~1.5%; the mass percent of the coal ash is 1.0~5.0% and preferably is 1.5~3.0%.

In said stowing method, the slurry can be delivered by means of pumping pressure, automatic flow of slurry or vehicle transportation. The involved delivery ways and equipment are all common ones in the art.

The stowing method provided by the present invention is suitable for the existing goaf of potash salt ore, and preferably suitable for the goaf of carnallite.

The stowing method of the present invention uses the wall slurry of high strength that is solidified with a gelling agent as the main bearing material, and uses the solidified filling slurry with a low strength as the main filling material, thus the average density can be adjusted to be close to the density of raw ore, which leads to excellent stowing effect, and the situations after stowing such as surface subsidence will not occur in the goaf.

As for the slurry used in the stowing method of the present invention, when compared with the existing filling materials into which the normal silicate cement and magnesium cement are added, the amount of additives is smaller, the solidification time is shorter, the stowing strength is more adjustable, and the cost is lower. Moreover, the present method effectively utilizes the tailings and the tail liquids, thereby reducing the amount of other additives, decreasing the cost, avoiding the discharge of liquid waste and relieving the environmental pressure.

Wherein, 1. an underground tunnel; 2. a portion that is filled by filling slurry; 3 a portion that is filled by wall slurry.

DETAILED DESCRIPTION

The following embodiments are used for describing the present invention only, but not for limiting the scope of the present invention.

Example 1

Figure 1:
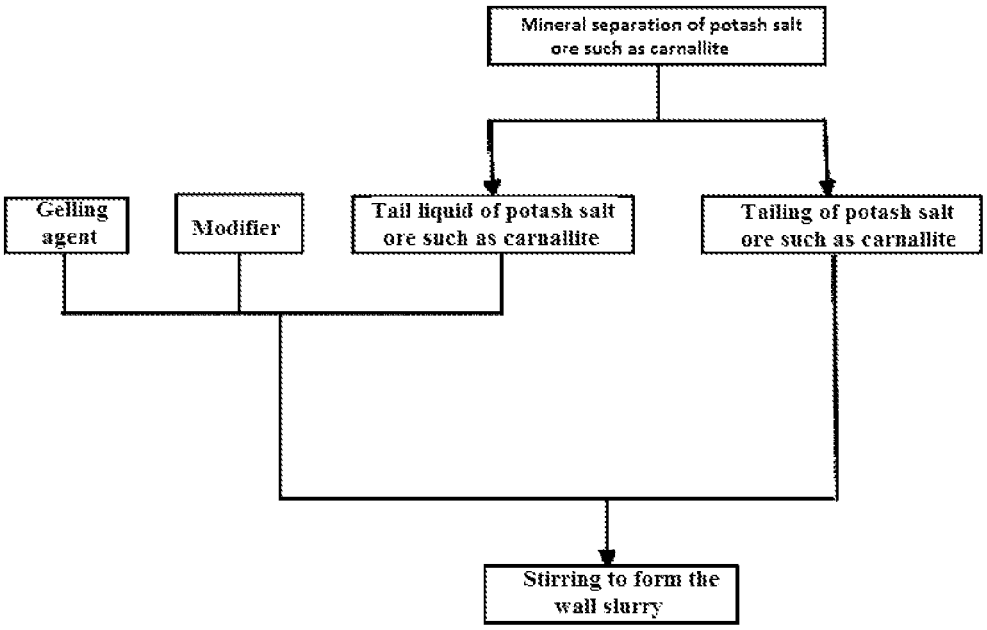
FIG. 1 illustrates a flow chart showing the process for preparing the wall slurry according to the present invention.
Figure 2:
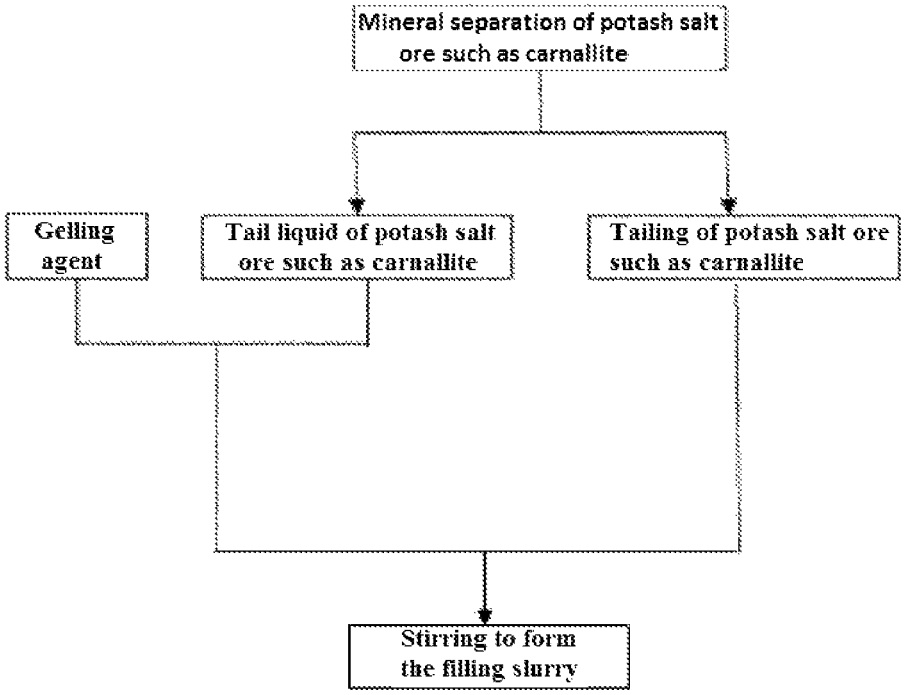
FIG. 2 illustrates a flow chart showing the process for preparing the filling slurry according to the present invention.

As shown in FIG. 1 and FIG. 2, according to a common flotation method, firstly, a potash salt ore such as carnallite is separated to obtain the tail liquids and the tailings thereof. The tail liquid containing about 24% of magnesium chloride is concentrated by normal ways such as evaporation under sun exposure, so as to obtain a mass percent of 29~36% for the magnesium chloride.

1. Preparation of Wall Slurry

A gelling agent and a modifier are added into the concentrated tail liquids.

After being mixed uniformly, the tailing of potash salt ore such as carnallite is added, then the wall slurry can be formed after further stirring and mixing uniformly; the stirring time is 20~30 minutes, and the slurry begins solidifying after 60~120 minutes from the completion of its preparation.

In the wall slurry, the mass of the tail liquid of carnallite potash salt ore that is added accounts for 20%~40%, preferably 30%~40%; the mass of magnesium oxide that is added accounts for 0%~17%; the mass of calcium oxide that is added accounts for 0~8%; the mass of the tailing of carnallite potash salt ore that is added accounts for 30%~60%, preferably 40%~60%; the mass of sodium silicate that is added accounts for 0.5~1.5%; the mass of sodium phosphate that is added accounts for 0.5~1.5%; the mass of coal ash that is added accounts for 1~5.0% and preferably 1.5~3.0%.

The relationship between the content of different magnesium oxides and the strength of corresponding wall slurry after solidifying are shown in table 1.

TABLE 1 the strength relationship of wall slurry according to different ratios after solidifying for 28 days

| | compositions | | | | | | | | |
|---|---|---|---|---|---|---|---|---|---|
| | gelling agent | | modifier | | | | | compressive strength | flexural strength |
| types | MgO | CaO | sodium silicate | sodium phosphate | coal ash | Tail liquids | tailings | (MPa) | (MPa) |
| I | 17.0% | / | 1.4% | 1.4% | 1.7% | 40.0% | 38.5% | 35.1 | 8.8 |
| II | 16.0% | 4.0% | 1.1% | 1.1% | 2.8% | 35.0% | 40.0% | 4.1 | 2.0 |
| III | / | 8.1% | 0.9% | 0.9% | 2.3% | 30.0% | 57.8% | 0.8 | 0.6 |

The process of preparing the wall slurry can be performed by using existing equipment. For example, the tail liquids of potash salt ore such as carnallite can firstly be fed into a stirring tank with the feeding amount being adjustable; at the same time, the gelling agent material and the modifier material can be successively fed into the stirring tank from their respective storage bins with the feeding amount being adjustable; after being mixed uniformly, the tailing of potash salt ore such as is delivered into the stirring tank by a convey belt with the feeding amount being adjustable, and stirred uniformly therein, so that the wall slurry is prepared.

2. Preparation of Filling Slurry

A gelling agent is added into the tail liquid of potash salt ore such as carnallite.

After being mixed uniformly, the tailing of potash salt ore such as carnallite is added, then the filling slurry can be formed by further stirring; the slurry begins solidifying after 45~240 minutes from the completion of the slurry preparation.

In the filling slurry, the mass of the tail liquid of potash salt ore such as carnallite that is added accounts for 17%~46%; the mass of the tailing of potash salt ore such as carnallite that is added accounts for 50%~80%; and the mass of gelling agent that is added accounts for 1%~5%.

The process of preparing the filling slurry can be performed by using existing equipment. For example, the tail liquid of potash salt ore such as carnallite can firstly be fed into a stirring tank with the feeding amount being adjustable; at the same time, the gelling agent can be fed into the stirring tank from a storage bin with the feeding amount being adjustable; after being mixed uniformly, the tailing of carnallite potash salt ore is delivered into the stirring tank by a convey belt with the feeding amount being adjustable, and is mixed uniformly therein, so that the filling slurry is formed.

3. Stowing Process

Figure 3:
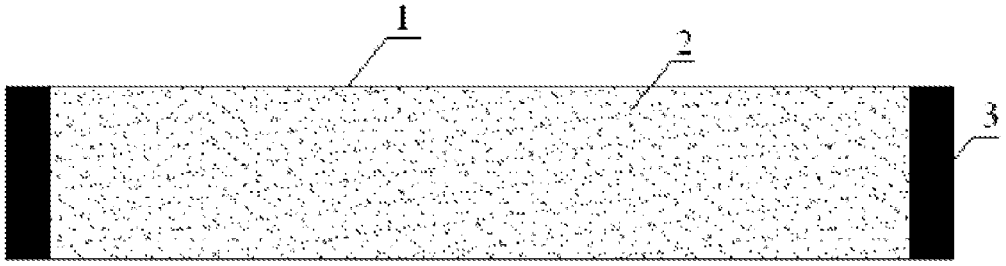
FIG. 3 illustrates a sectional view of an underground tunnel in a goaf along the length direction after filled by the stowing method according to the present invention.

Performing stowing by using the wall slurry and the filling slurry. FIG. 3 is a schematic view of the stowing of underground tunnels.

Stowing method 1: the prepared wall slurry is firstly transported to the underground goaf by vehicles. By means of common grouting methods for cement modeling, a barricade is made which has the same sectional area (a section that is vertical to the length direction of the tunnel) as that of the tunnel and a thickness of 0.5~5 m, or has a sectional area and a thickness that are determined by actual conditions, and the interval between two adjacent barricades is controlled within a range of 5~100 m or determined by actual conditions; then the mixed filling slurry is transported to the outside of the underground barricade body by means of pumping pressure, and injected between the barricades to replete the interval by means of spray pumping, until contacting the roof. After the slurry is solidified, the goaf stowing process is completed.

Stowing method 2: the prepared wall slurry is pumped into the goaf by means of pumping pressure, after it begins solidifying, a barricade is made which has the same sectional area as that of the tunnel and a thickness of 0.5~5 m or has a sectional area and thickness that are determined by actual conditions, and the interval between two adjacent barricades is controlled within a range of 5~100 m or determined by actual conditions; the underground tailing and tail liquid are directly transported to the area between the barricades for stowing, then the gelling agent for the filling material is pumped into the stowing area by means of cement grouting pump, so that the materials are mixed and solidified between the barricades due to gravity. After the slurry is solidified, the goaf stowing process is completed.

Example 2

As for the goaf of potash salt ore such as carnallite, according to a common flotation method, the potash salt ore such as carnallite is firstly separated to obtain the tail liquid and the tailing. The tail liquid containing about 24% of magnesium chloride, is concentrated by evaporation under sun exposure, so that the mass percent of magnesium chloride therein can reach about 29%.

1. Preparation of Wall Slurry

A gelling agent and a modifier are successively added into the concentrated tail liquid. After being mixed uniformly by stirring, the tailing of potash salt ore such as carnallite is added; then the wall slurry can be formed by further stirring and mixing uniformly; each stirring time is about 25 minutes.

In the wall slurry, the mass of the tail liquid of potash salt ore such as carnallite that is added accounts for 35%; the mass of magnesium oxide that is added accounts for 16%; the mass of calcium oxide that is added accounts for 4.0%; the mass of the tailing of potash salt ore such as carnallite that is added accounts for 40%; the mass of sodium silicate that is added accounts for 1.1%; the mass of sodium phosphate that is added accounts for 1.1%; and the mass of coal ash that is added accounts for 2.8%.

2. Preparation of Filling Slurry

A gelling agent is added into the tail liquid of the potash salt ore such as carnallite.

After being mixed uniformly, the tailing of potash salt ore such as carnallite is added, then the filling slurry is formed by further mixing; the stirring time is about 20 minutes.

In the filling slurry, the mass of the tail liquid of potash salt ore such as carnallite that is added accounts for 37%; the mass of the tailing of potash salt ore such as carnallite that is added accounts for 60%; and the mass of gelling agent accounts for 3.0%.

3. Stowing Process

The prepared wall slurry and filling slurry are separately transported to the goaf of carnallite potash salt ore.

The wall slurry is firstly transported to the underground goaf. By means of a common grouting methods for cement modeling, a barricade is made which has the same sectional area as that of the tunnel and a thickness arbitrarily within a scope of 1~5 m, and the interval between two adjacent barricades is arbitrarily controlled within a scope of 5~20 m. Then the filling slurry is transported to the goaf by means of pumping pressure, and is injected between two barricades to replete the interval by means of spray pump, until contacting the roof. After the wall slurry and the filling slurry are solidified, the stowing process of the goaf is completed. The total volumes of the wall slurry and the filling slurry that are used have a ratio controlled at about 5:95.

The wall slurry and the filling slurry are separately retained for making standard test blocks which are to be placed in the goaf under same conditions, and a strength measurement is conducted after 28 days. The strength of the test blocks at this moment can reach 70~80% of their final strength. The measurement results are shown as follows:

TABLE 2 the strength of wall slurry and filling slurry of example 2 after solidifying for 28 days

| | compositions | | | | | | | | |
|---|---|---|---|---|---|---|---|---|---|
| | gelling agent | | modifier | | | | | compressive strength | flexural strength |
| types | MgO | CaO | sodium silicate | sodium phosphate | coal ash | tail liquids | tailings | (MPa) | (MPa) |
| wall slurry | 16.0% | 4.0% | 1.1% | 1.1% | 2.8% | 35.0% | 40.0% | 4.1 | 2.0 |
| stowing slurry | / | 3.0% | / | / | / | 37.0% | 60.0% | 0.5 | 0.2 |

The average density of filling materials inside the tunnels of the underground goaf is 1.9, which is close to the density of the raw potash salt ore such as carnallite, therefore situations after stowing such as surface subsidence will not occur, and the stowing effect is excellent.

Example 3

As for the goaf of potash salt ore such as carnallite, according to a common flotation method, the potash salt ore such as carnallite is separated to obtain the tail liquid and the tailing. The tail liquid containing about 24% of magnesium chloride is concentrated by evaporation under sun exposure, so that the mass percent of magnesium chloride therein can reach about 32%.

1. Preparation of Wall Slurry

A gelling agent and a modifier are successively added into the concentrated tail liquid. After being mixed uniformly by stirring, the tailing of potash salt ore such as carnallite is added; then the wall slurry is formed by further stirring and mixing uniformly; each stirring time is about 20 minutes.

In the wall slurry, the mass of the tail liquid of potash salt ore such as carnallite that is added accounts for 30% of the wall slurry; the mass of magnesium oxide that is added accounts for 14%; the mass of calcium oxide that is added accounts for 5.5%; the mass of the tailing of potash salt ore such as carnallite that is added accounts for 46.3%; the mass of sodium silicate that is added accounts for 1.0%; the mass of sodium phosphate that is added accounts for 1.0%; the mass of coal ash that is added accounts for 2.2%.

2. Stowing Process

The prepared wall slurry is transported to the goaf of carnallite potash salt ore.

The wall slurry is firstly transported to the underground goaf. By means of a common grouting methods for cement modeling, a barricade is made which has the same sectional area as that of the tunnel and a thickness arbitrarily within a scope of 0.5~5 m, and the interval between two adjacent barricades is arbitrarily controlled within a scope of 10~30 m. The tailing and the tail liquid of potash salt ore such as carnallite are directly filled between the barricades, and the gelling agent for the filling materials is injected into the stowing area by means of cement grouting pump, to make the filling slurry being mixed and solidified between the barricades. In the filling slurry, the mass of the tail liquid of potash salt ore such as carnallite that is added accounts for 29.5%; the mass of the tailing of potash salt ore such as carnallite that is added accounts for 68%; and the mass of gelling agent that is added accounts for 2.5%.

After the wall slurry and the filling slurry are solidified, the stowing process of the goaf is completed. The total volumes of the wall slurry and the filling slurry that are used are controlled at a ratio about 10:90.

The wall slurry and the filling slurry are separately retained for making standard test blocks which are to be placed in the goaf under same conditions, and a strength measurement is conducted after 28 days. The strength of the test blocks at this moment can reach 70~80% of their final strength. The measurement results are shown as follows:

TABLE 3 the strength of wall slurry and filling slurry of example 3 after solidifying for 28 days

| | compositions | | | | | | | | |
|---|---|---|---|---|---|---|---|---|---|
| | gelling agent | | modifier | | | | | compressive strength | flexural strength |
| types | MgO | CaO | sodium silicate | sodium phosphate | coal ash | tail liquids | tailings | (MPa) | (MPa) |
| wall slurry | 14.0% | 3.5% | 1.0% | 1.0% | 2.2% | 30.0% | 40.0% | 3.9 | 1.9 |
| stowing slurry | / | 2.5% | / | / | / | 29.5% | 68.0% | 0.4 | 0.2 |

The average density of filling materials inside the tunnels of the underground goaf is 1.9, which is close to the density of the raw potash salt ore such as carnallite, therefore, situations after stowing such as surface subsidence will not occur, and the stowing effect is excellent.

Although the present invention has been illustrated in details by the above general descriptions and embodiments, it is obvious for a person skilled in the art that, they may be modified or improved to some extent based on the present invention. Therefore, such modifications and improvements made without departing from the spirit of the present invention all will fall within the scope claimed by the present invention.

What claimed is:

1. A stowing method for a goaf of potash salt ore, the method comprising:

making a wall slurry into barricades inside underground tunnels in a goaf of potash salt ore, the barricades have the same area as the sectional area of a tunnel and has a thickness of 0.5 to 5 meters, with an interval between adjacent barricades of 5 to 100 meters; and filling a filling slurry between said barricades, wherein, said wall slurry is comprised of the following ingredients by weight:

a tail liquid of potash salt ore: 20~40%;

a tailing of potash salt ore: 30~60%;

a first gelling agent: 8~25%; and a modifier: 2~8%;

wherein, said filling slurry is comprised of the following ingredients by weight:

a tail liquid of potash salt ore: 17~46%;

a tailing of potash salt ore: 50~80%; and a second gelling agent: 1~5%.

2. The stowing method of claim 1, characterized in that, said wall slurry is prepared by a method comprising: adding the first gelling agent and the modifier into the tail liquid of potash salt ore, after stirring uniformly, further adding the tailing of potash salt ore and mixing uniformly so as to obtain the wall slurry;

and that, said filling slurry is prepared by a method comprising:

adding the second gelling agent into the tail liquid of potash salt ore, after stirring uniformly, further adding the tailing of potash salt ore and mixing uniformly so as to obtain the filling slurry.

3. The stowing method of claim 1 or 2, characterized in that, said filling slurry is prepared in advance and then filled between said barricades, or, said filling slurry is formed by separately filling the raw materials into the interval between the barricades and mixing them therein.

4. The stowing method of claim 1 or 2, characterized in that, the mass percent of magnesium chloride in the tail liquid of potash salt ore is 29~36%.

5. The stowing method of claim 1 or 2, characterized in that, each of the first and second gelling agent is selected from the group consisting of magnesium oxide, calcium oxide, and a mixture thereof.

6. The stowing method of claim 5, characterized in that, in the wall slurry, the mass percent of magnesium oxide is 0~17% and the mass percent of calcium oxide is 0~8%; preferably, the mass percent of magnesium oxide is 10~16% and the mass percent of calcium oxide is 2~6%.

7. The stowing method of claim 5, characterized in that, each of the first and second gelling agent in the stowing slurry is calcium oxide.

8. The stowing method of claim 1 or 2, characterized in that, the modifier is a mixture of sodium silicate, sodium phosphate and coal ash.

9. The stowing method of claim 8, characterized in that, in the wall slurry, the mass percent of sodium silicate is 0.5~1.5%, the mass percent of sodium phosphate is 0.5~1.5%, and the mass percent of coal ash is 1.0~5.0%.

10. The stowing method of claim 1 or 2, characterized in that, the wall slurry and the filling slurry are delivered by means of pumping pressure, automatic flow of slurry or vehicle transportation.

11. The stowing method of claim 1, wherein the potash salt ore is carnallite.

12. The stowing method of claim 1, wherein the tail liquid of the potash salt ore comprises 22~25% $MgCl_2$, 3.3%~4.4% KCl, and 1.8~3.3% of NaCl.

13. The stowing method of claim 1, wherein the tailing of the potash salt ore comprises greater than 90% NaCl.

* * * * *